US006136244A

United States Patent [19]

Rusticus et al.

[11] Patent Number: 6,136,244

[45] Date of Patent: Oct. 24, 2000

[54] PROCESS FOR PREPARING CELLULOSE FIBRES AND FILAMENTS

[75] Inventors: Sven Jorgen Rusticus, Zeist; Eleonoor Van Andel, Enschede, both of Netherlands

[73] Assignee: Akzo Nobel N.V., Arnhem, Netherlands

[21] Appl. No.: 09/125,305

[22] PCT Filed: Feb. 13, 1997

[86] PCT No.: PCT/EP97/00694

§ 371 Date: Aug. 14, 1998

§ 102(e) Date: Aug. 14, 1998

[87] PCT Pub. No.: WO97/30196

PCT Pub. Date: Aug. 21, 1997

[30] Foreign Application Priority Data

Feb. 14, 1996 [NL] Netherlands ..... 1002338

[51] Int. Cl.[7] ..... D01D 5/18; D01F 2/02

[52] U.S. Cl. ..... 264/187; 264/211.1; 264/211.11; 264/211.14; 264/233

[58] Field of Search ..... 264/187, 211.1, 264/211.11, 211.14, 233

[56] References Cited

U.S. PATENT DOCUMENTS 5,401,447 3/1995 Matsui et al. ..... 264/187 X

FOREIGN PATENT DOCUMENTS

| | | |
|---|---|---|
| 71 44 34 | 11/1941 | Germany . |
| 54-027021 | 3/1979 | Japan . |
| 54 859 | 7/1943 | Netherlands . |
| 9 104 700 | 7/1991 | Rep. of Korea . |
| 9 208 999 | 10/1992 | Rep. of Korea . |
| 1 348 396 | 10/1987 | U.S.S.R. . |
| 1 397 456 | 5/1988 | U.S.S.R. . |
| 263 810 | 12/1926 | United Kingdom . |
| WO 96/06208 | 2/1996 | WIPO . |
| WO 96/27700 | 9/1996 | WIPO . |

*Primary Examiner*—Leo B. Tentoni
*Attorney, Agent, or Firm*—Oliff & Berridge, PLC

[57] ABSTRACT

The invention pertains to a process for producing cellulose fibers and filaments from a spinnable cellulose-containing solution, by spinning the solution using a centrifuge, with the solution which is spun containing 94–100 wt. % of the following constituents:
cellulose,
phosphoric acid and/or its anhydrides, and
water.

By means of this process cellulose fibers and filaments can be produced which have exceptionally favorable properties for both textile and industrial applications.

15 Claims, No Drawings

PROCESS FOR PREPARING CELLULOSE FIBRES AND FILAMENTS

BACKGROUND OF THE INVENTION

1. Field of the Invention

The invention pertains to a process for preparing cellulose fibres and filaments from a spinnable solution containing cellulose, the solution being spun using a centrifuge, the centrifuge having at least one spinning orifice, in which process the spinning solution after leaving the centrifuge is coagulated in a liquid, which liquid is enclosed in a jacket.

2. Description of Related Art

Such a process has been described in non-prepublished Netherlands international patent application WO 96/27700 in the name of Applicant.

As described in this application, various spinning solutions can be spun with the aid of a centrifuge. As compared with well-known wet spinning processes, such as the dry jet-wet spinning process, fibres and filaments can be made at a higher output rate when a centrifuge is used. Also, fibres/filaments can be made which possess superior properties for particular end uses, such as pulp.

Furthermore, compared with the known spinning processes, a spinning process using a centrifuge is not susceptible to filamentation while the spinning solution requires less fine filtration.

SUMMARY OF THE INVENTION

The invention pertains to the solution which is used to make cellulose fibres and filaments with the aid of a centrifuge. It was found that using this solution, which can be prepared very easily, makes it possible to produce cellulose fibres and filaments with very favourable properties, rendering these products highly suitable for use in textile as well as technical applications.

The invention consists in that in the process as described WO 96/27700 use is made of a solution containing 94–100 wt. % of the constituents:

cellulose,
phosphoric acid and/or its anhydrides, and
water.

DETAILED DESCRIPTION OF PREFERRED EMBODIMENTS

Cellulose solutions which can be used, e.g. for example, in the process according to the present invention are isotropic and anisotropic solutions containing 94–100 wt. % of the constituents cellulose, phosphoric acid and/or its anhydrides, and water. Such anisotropic solutions are described in non-prepublished patent application WO 96/06208, isotropic solutions are described in non-prepublished patent application NL 1002236, both applications in the name of the Applicant.

Cellulose-containing spinnable solutions which are used in the process according to the present invention are obtainable by dissolving cellulose in a solvent containing 65–80 wt. % of phosphorus pentoxide.

Spinnable solutions are solutions suitable for conversion into fibres or filaments by means of extrusion, coagulation, and winding.

In the case of cellulose derivatised with phosphoric acid, the percentages by weight of cellulose in the solution listed in this patent specification refer to quantities calculated back on the cellulose. This applies in analogous fashion to the quantities of phosphorus mentioned in this specification.

Cellulose derivatized with phosphoric acid is included among the constituents making up 94–100 wt. % of the solution.

The term phosphoric acid in this patent application refers to all inorganic acids of phosphorus and their mixtures. Orthophosphoric acid is the acid of pentavalent phosphorus, that is $H_3PO_4$. Its anhydrous equivalent, that is the anhydride, is phosphorus pentoxide $P_2O_5$. In addition to orthophosphoric acid and phosphorus pentoxide there is, depending on the quantity of water in the system, a series of acids of pentavalent phosphorus with a water-binding capacity in between those of phosphorus pentoxide and orthophosphoric acid, such as polyphosphoric acid ($H_6P_4O_{13}$, PPA).

In the present patent specification the solvent by definition is made up of the added phosphoric acid and/or its anhydrides and all the free water present in the solution. For that reason this description always includes in the solvent the water originating from the cellulose, which is usually added at a later time, while water from substances which are among the remaining constituents also is part of the solvent.

The phosphorus content of the solvent is determined by converting the quantities by weight of phosphoric acid in the solvent into the equivalent quantity by weight of the corresponding anhydride. Converted in this manner, orthophosphoric acid is made up of 72.4 wt. % of phosphorus pentoxide and residual water, and $H_6P_4O_{13}$ of 84 wt. % of phosphorus pentoxide and residual water.

The $P_2O_5$ concentration in the solvent is calculated by starting from the overall quantity by weight of phosphoric acid including its anhydrides and the overall quantity of water in the solvent, converting the acids into $P_2O_5$ and water, and calculating the percentage of said overall quantity by weight made up by $P_2O_5$.

In addition to water, phosphoric acid and/or its anhydrides, and cellulose and/or reaction products of phosphoric acid and cellulose, other substances may be present in the solution.

The solution can be prepared by mixing constituents classifiable into four groups: cellulose, water, phosphoric acid including its anhydrides, and other constituents. The "other constituents" may be substances which benefit the processability of the cellulose solution, solvents other than phosphoric acid, or adjuvants or additives, for example to counter cellulose degradation as much as possible, or dyes and the like.

Preferably, the solution is composed of 96–100 wt. % of the constituents cellulose, phosphoric acid and/or its anhydrides, and water.

Preferably, no solvents other than phosphoric acid are employed, and adjuvants or additives are present only in amounts of 0 to 4 wt. %, calculated on the overall quantity by weight of the solution. More preferable still is a solution containing the lowest possible quantity of substances other than the constituents cellulose, phosphoric acid and/or its anhydrides, and water, that is, with from 0 to 1 wt. % of additives.

In the process according to the invention preferably use is made of a centrifuge such as described in non-prepublished international patent application WO 96/27700 in the name of Applicant.

Such an apparatus has one or more spinning orifices distributed more or less evenly over the outer circumference of the centrifuge. Rotation of the centrifuge causes the solution, which is fed to the centrifuge under pressure via a feed line, to be extruded in the direction of the jacket. Depending on the rotational speed of the centrifuge the solution is drawn after being extruded. On coming into contact with the liquid flowing along the jacket the drawn solution coagulates and fibres or endless filaments are formed. The degree of drawing can be set, among other ways, through the rotational speed of the centrifuge and the distance between the outer circumference of the centrifuge and the inside of the jacket enclosing the coagulating liquid.

In order to obtain proper filament drawing the inner radius of the jacket enclosing the coagulating liquid is at least 10% wider than the radius of the outer circumference of the centrifuge, more particularly, it is at least 25% wider, most particularly, at least 35% wider. The maximum degree of drawing is dependent, among other things, on the cellulose degree of polymerization, DP, and the cellulose concentration in the solution. Exceeding the maximum degree of drawing will lead to filamentation in the space between the centrifuge and the coagulating liquid.

Proper centrifuge action does not require rotation to be restricted to the centrifuge. Alternatively, the jacket along which the coagulating liquid moves may rotate, either in the same direction as the centrifuge or in the one opposite to it.

In preferable process the axis of rotation of the centrifuge is positioned more or less vertically and the coagulating liquid flows downward along the jacket, in which case the formed fibres/filaments will flow out of the jacket together with the coagulating liquid and can be collected and combined into slivers. The number of fibres and the fibre length play an important part in the formation of such slivers. When the sliver has sufficient cohesion, it can be neutralized, washed, and dried in a continuous process.

The diameter of the spinning orifices plays an important part in this centrifugal spinning process according to the invention. As this diameter increases, the risk of clogging as a result of impurities or undissolved particles in the solution will be reduced. Preferably, the spinning orifices used have a diameter of more than 100 $\mu$m, more particularly, a diameter in the range of 120 to 500 $\mu$m.

Suitable coagulating liquids may be selected from the group of low-boiling organic solvents and water or mixtures of these solvents. Examples of such suitable coagulants are alcohols, ketones, esters, and water, or mixtures thereof. Preferably, the coagulant used is acetone, ethanol or water.

If water is used as a coagulant, preference is given to the use of water with cations added thereto, preferably a solution which contains monovalent cations as, for example, $Li^+$, $Na^+$, $K^+$ or $NH_4^+$. Such solutions can be obtained by solving lithium, sodium, potassium or ammonium phosphate in water.

From the same group mentioned above of low-boiling organic solvents and water or mixtures of these solvents, suitable washing liquids may be selected. Examples of such suitable washing liquids are alcohols, ketones, esters, and water, or mixtures thereof. The use of water as washing liquid is preferred.

After coagulation and washing the resulting product, such as, a cellulose sliver, can be finished and dried. The product can be rendered suitable for further treatment by cutting or chopping, for example, to obtain cellulose pulp or cellulose staple fibres.

The cellulose to be used in the preparation of the spinnable solution preferably has an $\alpha$-content of more than 90%, more preferably greater than 95%. For spinning good fibres from the solutions it is recommended to employ so-called dissolving pulp having a high $\alpha$-content, for example, such as is commonly used to make fibres for textile and industrial applications. Examples of suitable types of cellulose include Alphacell C-100, Arbocell BER 600/30, Buckeye V5, Buckeye V60, Buckeye V65, Buckeye Cotton Linters, and Viscokraft.

In an advantageous process the preparation of the spinnable solution and the spinning of this solution is performed in a continuous way. In WO 96/06208 several methods are mentioned for the preparation of the solution in a continuous way, for example, by using a twin-screw extruder in the preparation of the solution.

The process according to the present invention can be used to make cellulose fibres with a very wide range of mechanical properties. For instance, it is possible to make cellulose fibres which are highly suitable for textile uses, by way of example, fibres having a high elongation at break, for example, an elongation at break of more than 10%, as well as very good dye receptivity. The obtained cellulose fibres can be employed, for example, as a substitute for cotton.

Alternatively, fibres of high tenacity can be made, for example, with a tenacity if more than 500 mN/tex, properties which render the fibres suitable for use as reinforcing material for industrial application.

The process according to the present invention further is highly suited to be used for preparing a cellulose material with a high water and salt solutions absorbency, i.e. cellulose products with high absorbent and superabsorbent properties. As described in the non-prepublished patent application NL 1002335 in the name of Applicant, it was found that such materials can be prepared if a solution containing 94–100 wt. % of the constituents cellulose, phosphoric acid and/or its anhydrides and water is coagulated and washed in a liquid containing less than 50 wt. % of water.

To make cellulose fibres or filaments having a high water and salt solutions absorbency using the process according to the present invention, a cellulose solution which preferably contains more than 1.5 wt. % of cellulose-bound phosphorus is spun with the aid of a centrifuge and coagulated in a liquid containing less than 50 wt. % of water, more particularly in a liquid containing less than 10 wt. % of water, more preferably still in a liquid which is essentially anhydrous. In this application, a liquid is deemed to be essentially anhydrous when it contains less than 5 wt. % of water.

In a highly preferable process the coagulating liquid employed is acetone, propanol, or ethanol.

To make such fibres or filaments the coagulated fibres or filaments can then be washed in a washing liquid containing less than 50 wt. % of water. However, it is preferred to employ a washing liquid containing less than 10 wt. % of water, more particularly a washing liquid which is essentially anhydrous.

Determination of isotropy/anisotropy

Visual determination of the isotropy or of the solution was performed with the aid of a polarization microscope (Leitz Orthoplan-Pol (100x)). To this end about 100 mg of the solution to be defined were arranged between two slides and placed on a Mettler FP 82 hot-stage plate, after which the heating was switched on and the specimen heated at a rate of about 5° C/min. In the transition from anisotropic to isotropic, that is, from coloured, or birefringent, to black, the temperature is read off at virtual black. The transition temperature is indicated as $T_{ni}$.

The visual assessment during the phase transition was compared with an intensity measurement using a photosensitive cell mounted on the microscope. For this intensity measurement a specimen of 10–30 $\mu$m was arranged on a slide such that no colours were visible when crossed polarizers were employed. Heating was carried out as described above. The photosensitive cell, connected to a recorder, was used to write the intensity as a function of time. Above a certain temperature which differs for the different solutions, there was a linear decrease of the intensity. Extrapolation of this line to an intensity of 0 gave the $T_{ni}$. In all cases, the value found proved a good match for the value found by the above-mentioned method.

Isotropic solutions do not display birefringence at room temperature. This means that $T_{ni}$ will be below 25° C. However, it may be the case that such solutions do not display an isotropy/anisotropy transition.

Determination of DP

The degree of polymerization (DP) of the cellulose was determined with the aid of an Ubbelohde type 1 (k=0.01). To this end the cellulose specimens to be measured were dried in vacuo for 16 hours at 50° C. after neutralization, or the amount of water in the copper 11 ethylene diamine/water mixture was corrected to take into account the water in the cellulose. In this way a 0.3 wt. % of cellulose-containing solution was made using a copper 11 ethylene diamine/water mixture (1/1). On the resulting solution the viscosity ratio (visc. rat. or $\eta_{rel}$) was determined, and from this the limiting viscosity ($\eta$) was determined in accordance with the formula:

$$[\eta] = \frac{\text{visc. rat} - 1}{c + (k \times c \times (\text{visc. rat.} - 1))} \times 100$$

wherein c=cellulose concentration of the solution (g/dl) and k=constant=0.25

From this formula the degree of polymerisation DP was determined as follows:

$$DP = \frac{[\eta]}{0.42} \text{ (for } [\eta] < 450 \text{ ml/g), or}$$

$$DP^{0.76} = \frac{[\eta]}{2.29} \text{ (for } [\eta] > 450 \text{ ml/g)}$$

Determining the DP of the cellulose in the solution proceeded as described above after the following treatment:

20 g of the solution were charged to a Waring Blender (1 liter), 400 ml of water were added, and the whole was then mixed at the highest setting for 10 minutes. The resulting mixture was transferred to a sieve and washed thoroughly with water. Finally, there was neutralization with a 2%-$NaHCO_3$ solution for several minutes and after-washing with water to a pH of about 7. The DP of the resulting product was determined as described above, starting from the preparation of the copper 11 ethylene diamine/water/cellulose solution.

Determination of phosphorus content

The quantity of phosphorus bound to the cellulose in the solution, or in a cellulose product made using said solution, can be determined by 300 mg of cellulose solution, which solution has been coagulated and, after thorough washing for 16 hours at 50° C., dried in vacuo and then stored in a sealed sampling vessel, being combined in a decomposition flask with 5 ml of concentrated sulphuric acid and 0.05 ml of an Yttrium solution containing 1000 mg/l of Yttrium. The cellulose is carbonized with heating. After carbonization hydrogen peroxide is added to the mixture in portions of 2 ml, until a clear solution is obtained. After cooling the solution is made up with water to a volume of 50 ml. ICP-ES (Inductive Coupled Plasma—Emission Spectrometry, ICP-ES) is used to measure, by means of a phosphorus calibration line determined using reference samples containing 100, 40, 20, and 0 mg/l of phosphorus, respectively, the phosphorus content in the solution to be measured with the aid of the following equation:

$$\text{phosphorus content (\%)} = (P_{conc}(\text{mg/l}) \times 50)/(C_w(\text{mg}) \times 10)$$

wherein: $P_{conc}$=the phosphorus concentration in the solution to be measured and $C_w$=the weighed out quantity of coagulated and washed cellulose.

Yttrium is added as internal standard to correct the solutions' viscosity variations. The phosphorus content is measured at a wavelength of 213.6 nm, the internal standard is measured at a wavelength of 224.6 nm.

Mechanical properties

The mechanical properties of the filaments and the yarns were determined in accordance with ASTM standard D2256-90, using the following settings.

The mechanical properties were measured on filaments and fibres clamped with ARNITEL® gripping surfaces of 10×10 mm. The filaments and fibres were conditioned for 16 hours at 20° C. and 65% relative humidity. The length between grips was 100 mm, and the filaments and fibres were elongated at a constant elongation of 10 mm/min.

The linear density of the filaments and fibres, expressed in dtex, was calculated on the basis of the functional resonant frequency according to ASTM D 1577-66, Part 25, 1968 or by means of weighing.

The tenacity, elongation, and initial modulus were derived from the load-elongation curve and the measured fibre or filament linear density.

The initial modulus (In. Mod.) was defined as the maximum modulus at an elongation of less than 2%.

EXAMPLES

The invention will be illustrated below with reference to examples. Unless otherwise specified, the following starting materials were employed to prepare the solutions in the examples. Material Manufacturer and product code Content

| Material | Manufacturer and product code | Content $P_2O_5$ [%] |
|---|---|---|
| $P_2O_5$ | J. T. Baker, 0193 | 98 |
| $H_3PO_4$ | La Fonte Electrique SA, Bex Suisse crystallised, >99% (98.3% analysed) | 71.2 |
| $H_4P_2O_7$ | Fluka Chemika, 83210, 97% (98.8% anal.) | 78.8 |
| PPA* | Caldic | 84.5 |

*PPA = polyphosphoric acid

Example 1

An anisotropic cellulose solution was prepared by dissolving 3270 g of powdered cellulose (Buckeye V65, DP=700) in a solvent, said solvent having been obtained by mixing and kneading 13,600 g of $H_3PO_4$ and 3400 g of PPA for several hours at approximately 50° C. The cellulose and the solvent were kneaded and mixed for 20 minutes at 20° C. until a homogeneous anisotropic solution was obtained. During the final 15 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 24 spinning orifices each having a diameter of 400 μm. At a temperature of about 60° C., a mass flow rate of 13 kg of solution per hour, and a rotational speed of the centrifuge of 1500 revolutions per minute, the solution was extruded through the spinning orifices. The formed fibres were coagulated using water of 15° C. which flowed downward along a jacket. The jacket had an inner diameter of 60 cm.

The resulting fibre sliver was collected, washed with a 2% sodium bicarbonate solution and washed with water until the material had a pH=7. Next, the sliver, after being finished with RT32A, was dried at 25° C.

The filaments in the sliver had a linear density in the range of 11 to 23 dtex. The breaking tenacity of the filaments was 85 to 165 mN/tex, their elongation at break 8 to 20%. The cellulose DP in the filaments was 470.

Example 2

An anisotropic cellulose solution was prepared by dissolving 3270 g of powdered cellulose (Buckeye V60, DP=820) in a solvent, said solvent having been obtained by mixing and kneading 13,600 g of $H_3PO_4$ and 3400 g of PPA for several hours at approximately 50° C. The cellulose and the solvent were kneaded and mixed for 20 minutes at 20° C. until a homogeneous anisotropic solution was obtained. During the final 15 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 48 spinning orifices each having a diameter of 400 μm. At a temperature of about 45° C., a pressure of 50–65 bar, measured in the feed line above the centrifuge, a mass flow rate of 13 kg of solution per hour, and a rotational speed of the centrifuge of 3000 revolutions per minute, the solution was extruded through the spinning orifices. The formed fibres were coagulated using water of 15° C. which flowed downward along a jacket. The jacket had an inner diameter of 60 cm.

The resulting fibre sliver was collected, washed with a 2% sodium bicarbonate solution and washed with water until the material had a pH=7. Next, the sliver, after being finished with RT32A, was dried at 25° C.

The filaments in the sliver had a linear density in the range of 2.6 to 18 dtex. The breaking tenacity of the filaments was 100 to 240 mN/tex, their elongation at break 6 to 13%.

The content of cellulose-bound phosphorus in the filaments was 0.33%. The obtained filaments' dye receptivity to Solophenyl Bleu GL of 250% was a significant improvement on the dye receptivity of textile filaments made using the viscose process.

Example 3

An anisotropic cellulose solution was prepared by dissolving 2550 g of powdered cellulose (Alphacell C-100, DP=2300) in a solvent, said solvent having been obtained by mixing and kneading 18,400 g of $H_3PO_4$ and 4600 g of PPA for several hours at approximately 50° C. The cellulose and the solvent were kneaded and mixed for 65 minutes at 23° C. until a homogeneous anisotropic solution was obtained. During the final 50 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 24 spinning orifices each having a diameter of 400 μm. At a temperature of about 60° C., a pressure of about 60 bar, measured in the feed line above the centrifuge, a mass flow rate of 24 kg of solution per hour, and a rotational speed of the centrifuge of 2000 revolutions per minute, the solution was extruded through the spinning orifices. The formed fibres were coagulated using water of 15° C. which flowed downward along a jacket. The jacket had an inner diameter of 60 cm.

The resulting fibre sliver was collected, washed with a 2% sodium bicarbonate solution and washed with water until the material had a pH=7. Next, the sliver, after being finished with RT32A, was dried at 25° C.

The filaments in the sliver had a linear density in the range of 1,7 to 21 dtex. The breaking tenacity of the filaments was 40 to 900 mN/tex, their elongation at break 1.3 to 11%.

Example 4

An anisotropic cellulose solution was prepared by dissolving 2688 g of powdered cellulose (Buckeye V65, DP=700) in a solvent, said solvent having been obtained by mixing and kneading at elevated temperature 19360 g of $H_3PO_4$ and 4840 g of PPA for several hours at approximately 50° C. The cellulose and the solvent were kneaded and mixed for 65 minutes at 16° C. until a homogeneous anisotropic solution was obtained. During the final 45 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 24 spinning orifices each having a diameter of 250 μm. At a temperature of about 45° C., a mass flow rate of 12 kg of solution per hour, and a rotational speed of the centrifuge of 3500 revolutions per minute, the solution was extruded through the spinning orifices. The formed fibres were coagulated using water of 15° C. which flowed downward along a jacket. The jacket had an inner diameter of 50 cm.

The resulting fibre sliver was collected, washed with a 2% sodium bicarbonate solution and washed with water until the material had a pH=7. Next, the sliver, after being finished with RT32A, was dried at 25° C.

The fibres in the sliver had an average linear density of 3.3 dtex, an average breaking tenacity of 77 mN/tex, and an average elongation at break of 10%.

Example 5

An anisotropic cellulose solution was prepared by dissolving 3017 g powdered cellulose (Buckeye V65, DP=700) in a solvent containing 76.3 wt. % phosphorus pentoxide, said solvent having been obtained by mixing and kneading at elevated temperature of 17.6 kg $H_3PO_4$ and 10.6 kg PPA for several hours at approximately 50° C. The cellulose and the solvent were kneaded and mixed for 170 minutes at 21° C. until a homogeneous anisotropic solution was obtained. During the final 95 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 24 spinning orifices each having a diameter of 250 μm. At a temperature of about 45° C., a pressure of about 170 bar, measured in the feed line above the centrifuge, a mass flow rate of 13 kg of solution per hour, and a rotational speed of the centrifuge of 3500 revolutions per minute, the solution was extruded through the spinning orifices. The formed fibres were coagulated using n-propanol of 15° C. which flowed downward along a jacket. The jacket had an inner diameter of 50 cm.

The resulting fibre sliver was collected, washed with a 2% sodium bicarbonate solution in acetone and washed with acetone until the material had a pH=7. Next, the sliver, after being finished with RT32A, was dried at 25° C.

The fibres in the sliver had an average linear density of 3.7 dtex, an average breaking tenacity of 70 mN/tex, an average elongation at break of 2.9%, and a content of cellulose-bound phosphorus of 7.2%. The water absorption under pressure of these fibres is 9 g/g. The LOI index of the obtained material was 31%.

Example 6

An isotropic cellulose solution was prepared by dissolving 807 g of powdered cellulose (Buckeye V65, DP=700) in a solvent, said solvent having been obtained by mixing and kneading 15267 g of $H_3PO_4$ and 4306 g of PPA for several hours at approximately 50° C. The cellulose and the solvent were kneaded and mixed for 70 minutes at 12° C. until a homogeneous isotropic solution was obtained. During the final 25 minutes the solution in the kneader was degassed.

This solution was spun with the aid of a centrifuge, as described in non-prepublished international patent application WO 96/27700 in the name of Applicant, the centrifuge with an outer diameter of 30 cm being provided with 24 spinning orifices each having a diameter of 250 $\mu$m. At a temperature of about 45° C., a pressure of 10 to 40 bar, measured in the feed line above the centrifuge, a mass flow rate of 13 kg of solution per hour, and a rotational speed of the centrifuge of 3000 revolutions per minute, the solution was extruded through the spinning orifices. The formed fibres were coagulated in a solution at 15° C., which solution was obtained by mixing 48.7 parts by weight (pbw) water, 7.13 pbw KOH and 4.15 pbw $H_3PO_4$. This solution flowed downward along a jacket. The jacket had an inner diameter of 50 cm.

The resulting fibre sliver was collected, washed with a 2% sodium bicarbonate solution and washed with water until the material had a pH=7. Next, the sliver, after being finished with RT32A, was dried at 25° C. The fibres in the sliver had a linear density of 1.0 to 2.7 dtex, a breaking tenacity of 45 to 135 mN/tex, an elongation at break of 1 to 15%, and a cellulose-bound phosphorus content of 1.2 wt. %.

What is claimed is:

1. A process for producing cellulose fibres or filaments from a spinnable cellulose-containing solution, the solution comprising:

94–100 wt. % of cellulose, water and at least one of phosphoric acid and anhydrides of phosphoric acid; and further comprising the steps of:

spinning the solution using a centrifuge, the centrifuge having at least one spinning orifice;

removing the spun solution from the centrifuge in the form of cellulose fibres or filaments; and coagulating the spun solution in a liquid, wherein the liquid is enclosed in a jacket.

2. The process of claim 1, wherein the solution comprises 96–100 wt. % of cellulose, water and at least one of phosphoric acid and anhydrides of phosphoric acid.

3. The process of claim 1, wherein the solution comprises cellulose dissolved in a solvent, the solvent comprising 65–80 wt. % of phosphorus pentoxide.

4. The process of claim 1, wherein the jacket has an inner radius, the centrifuge has a radius of outer circumference, and wherein the inner radius of the jacket exceeds the radius of outer circumference of the centrifuge by at least 10%.

5. The process of claim 1, wherein the jacket has an inner radius, the centrifuge has a radius of outer circumference, and wherein the inner radius of the jacket exceeds the radius of outer circumference of the centrifuge by at least 25%.

6. The process of claim 1, wherein the jacket has an inner radius, the centrifuge has a radius of outer circumference, and wherein the inner radius of the jacket exceeds the radius of outer circumference of the centrifuge by at least 35%.

7. The process of claim 1, wherein the at least one spinning orifice has a diameter greater than 100 $\mu$m.

8. The process of claim 1, wherein the at least one spinning orifice has a diameter between 120 $\mu$m and 500 $\mu$m.

9. The process of claim 1, wherein the liquid for coagulating the spun solution is one of water, acetone and ethanol.

10. The process of claim 1, further comprising the step of washing the fibres and filaments with water.

11. The process of claim 1, wherein the solution comprises more than 1.5 wt. % of phosphorus bound to the cellulose, and wherein the liquid used for coagulating the solution comprises less than 50 wt. % of water.

12. The process of claim 1, wherein the liquid used for coagulating the solution comprises less than 10 wt. % of water.

13. The process of claim 1, wherein the liquid used for coagulating the solution is anhydrous.

14. The process of claim 1, wherein the liquid used for coagulating the solution comprises water and cations.

15. The process of claim 1, wherein the liquid used for coagulating the solution comprises water and monovalent cations.

* * * * *

UNITED STATES PATENT AND TRADEMARK OFFICE

CERTIFICATE OF CORRECTION

PATENT NO. : 6,136,244

DATED : October 24, 2000

INVENTOR(S) : Sven Jorgen RUSTICUS and Eleonoor VAN ANDEL

It is certified that error appears in the above-identified patent and that said Letters Patent is hereby corrected as shown below:

Please amend the above-identified patent as follows:

Title page, in item [57], replace the Abstract with:

--Cellulose fibres and filaments are prepared from a spinnable, cellulose-containing solution containing 94-100 wt. % cellulose, water, and phosphoric acid and/or anhydrides of phosphoric acid. The solution is fed into a centrifuge via a feed line and spun, and is extruded in the direction of the jacket. A coagulating liquid flows along the jacket, where the solution contacts the liquid and coagulates, forming fibres and/or endless filaments. To ensure proper filament drawing, the inner radius of the jacket is 10-35 % wider than the radius of the outer circumference of the centrifuge. The coagulating liquid may be water, acetone or ethanol. The coagulating liquid may also be anhydrous, or may contain water with cations.--

| | | |
|---|---|---|
| Column 1, | line 47, | delete "e.g."; and |
| | line 63, | change "derivatised" to --derivatized--. |
| Column 2, | line 7, | after "is", both occurrences, insert --,--; and |
| | line 45, | after "example" insert --,--. |
| Column 3, | line 49, | change "solving" to --dissolving--. |

UNITED STATES PATENT AND TRADEMARK OFFICE

CERTIFICATE OF CORRECTION

PATENT NO. : 6,136,244

DATED : October 24, 2000

INVENTOR(S) : Sven Jorgen RUSTICUS and Eleonoor VAN ANDEL

It is certified that error appears in the above-identified patent and that said Letters Patent is hereby corrected as shown below:

Please amend the above-identified patent as follows:

Column 4, line 26, change "i.e." to --for example,--;

line 54, after "isotropy or" insert --anisotropy--; and line 61, change "coloured" to --colored--.

Column 5, line 66-Column 6, line 1, change "ICP-ES (Inductive Coupled Plasma—Emission Spectrometry, ICP-ES)" to --Inductive Coupled Plasma—Emission Spectrometry, ICP-ES,--.

Column 6, line 22, delete "®"; and line 41, delete "Material Manufacturer and product code Content".

Column 8, line 24, change "obtained" to --prepared--.

Signed and Sealed this

Eighth Day of May, 2001

*Attest:*

Nicholas P. Godici

NICHOLAS P. GODICI

*Attesting Officer*

*Acting Director of the United States Patent and Trademark Office*